United States Patent [19]

Richards

[11] 3,938,577

[45] Feb. 17, 1976

[54] DOOR STRUCTURE EMPLOYING AN AUXILIARY DOOR

[76] Inventor: Stanzer Richards, 7791 24th St., Westminster, Calif. 92683

[22] Filed: Apr. 9, 1975

[21] Appl. No.: 566,297

[52] U.S. Cl. ..... 160/90; 160/113

[51] Int. Cl.[2] ..... E06B 9/01

[58] Field of Search ..... 160/89, 90, 91, 113, 114, 160/115, 118

[56] References Cited

UNITED STATES PATENTS

| | | | |
|---|---|---|---|
| 2,072,092 | 3/1937 | Blodgett | 160/113 |
| 3,004,592 | 10/1961 | Norton | 160/114 |
| 3,021,896 | 2/1962 | Buono et al. | 160/113 |
| 3,103,967 | 9/1963 | Gaschen | 160/113 |
| 3,126,944 | 3/1964 | Kempinski | 160/90 |

*Primary Examiner*—Marion Parsons, Jr.
*Attorney, Agent, or Firm*—Edward D. O'Brian

[57] ABSTRACT

Doors such as garage doors are commonly mounted with respect to a door opening so as to be capable of being moved between a closed position in which such a door extends vertically across the opening and an opened position in which such a door extends substantially horizontally adjacent to the top of the door opening. An auziliary door such as a screen door for enclosing such an opening when such a principal door is in an opened position may be mounted on such a principal door so that it is capable of being moved along with the principal door between the opened and closed positions of the principal door and so that it can be moved to enclose the door opening when the principal door is in an opened position.

11 Claims, 15 Drawing Figures

FIG. 12.
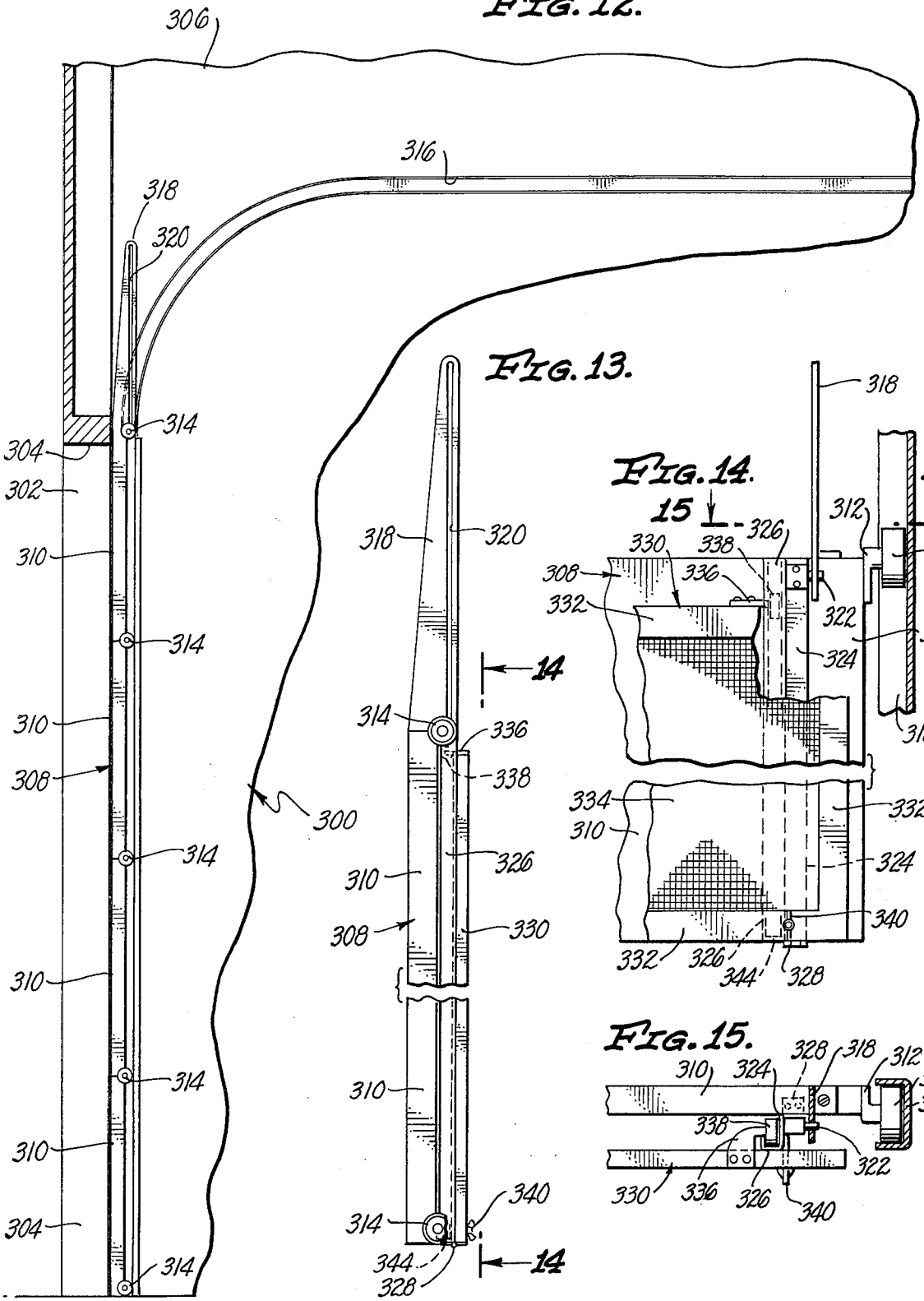
FIG. 13.
FIG. 14.
FIG. 15.
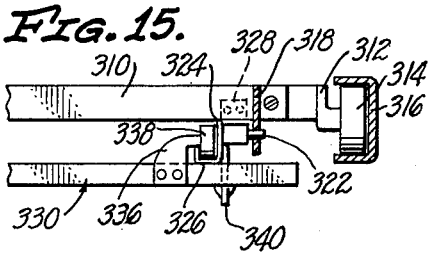

DOOR STRUCTURE EMPLOYING AN AUXILIARY DOOR

BACKGROUND OF THE INVENTION

The invention set forth in this specification is primarily directed to the combination of so-called overhead doors such as garage doors with auxiliary screen doors which can be utilized to close off a door opening when the principal door is in an opened position. The invention, however, is considered to be capable of being utilized with other than garage and/or screen doors.

The nature of the problem to which the invention set forth herein is directed can be best explained by referring to the utilization of many garages. Although in theory a garage is intended to be utilized in storing items such as vehicles in fact garages are commonly utilized for many other purposes. Frequently they are employed as workshops. Frequently they are employed as leisure areas. Because of the manner in which most garages are constructed they seldom have adequate ventilation and/or illumination for such various secondary uses.

As a consequence of this when garages are commonly employed for secondary purposes as are indicated in the preceding discussion it is commonplace for the doors to such garages to be left open. This is disadvantageous for several reasons. Since a garage is normally constructed so that its principal door is accessible from a street there is always the possibility of thievery occurring should a garage with its principal door opened be left unattended. Also, when such a door is left open there is the problem of insects and/or various types of animals entering such a door to the detriment of any person in a garage and/or any items within a garage.

A recognition of these factors has lead to a recognition of the desirability of providing an auxiliary screen door or an auxiliary screen door structure for use with conventional garage doors when such conventional doors are in an opened position. An understanding of the invention does not require a detailed consideration of such prior structures. Such prior structures are considered to be undesirable for one or more of a variety of different reasons. Frequently they are comparatively expensive and/or hard to install. Frequently they have been constructed so as to be disadvantageous because of the possibility of damage. It is considered that certain of them have been inconvenient to use.

SUMMARY OF THE INVENTION

An objective of the present invention is to overcome various problems and limitations of prior door structures employing an auxiliary door. An objective of the present invention is to provide overhead type doors such as are commonly utilized in garages with an auxiliary door such as a screen door which can be utilized to enclose a door opening when the principal door is in an opened position. Further objectives of the present invention are to provide door structures as described which may be fabricated and installed at a comparatively nominal cost, which may be easily and conveniently used as herein explained, and which are capable of giving prolonged, reliable performance with minimal maintenance. Another objective of the invention is to provide door structures as indicated in this specification which utilize existing overhead doors and which, hence, are advantageous in that they do not requite new and/or specially constructed principal doors.

In accordance with this invention these various objectives are achieved by providing in the combination of a principal door a first mounting means for supporting the principal door, a door frame defining a door opening, the first mounting means supporting the principal door so that it is capable of being moved between a substantially vertical closed position and a substantially horizontal opened position, an auxiliary door, an auxiliary mounting means for supporting the auxiliary door, the auxiliary mounting means supporting the auxiliary door so that it is capable of being used between a substantially closed position in which it extends across the door opening and an opened position, the improvement which comprises: the auxiliary mounting means supporting the auxiliary door on the principal door so that the auxiliary door is moved concurrently with the principal door when the principal door is moved between its closed and opened positions, and supporting the auxiliary door so that when the principal door is in its opened position the auxiliary door can be moved relative to the principal door from an opened position adjacent to the principal door to the closed position of the auxiliary door.

BRIEF DESCRIPTION OF THE DRAWINGS

A formalized summary of this type is best considered with reference to various specific structures embodying the concepts expressed in the summary. In the drawings:

FIG. 12 is a side elevational view showing a fourth embodiment or form of a door structure of this invention, this view being taken along a vertical plane just inside of a door jam and showing part of the door opening in section;

FIG. 13 is an enlarged detail view of a part of the structure visible in FIG. 12;

FIG. 14 is a partial cross-sectional view on an enlarged scale taken at line 14—14 of FIG. 13; and FIG. 15 is a partial cross-sectional view taken at line 15—15 of FIG. 14.

Figure 1:
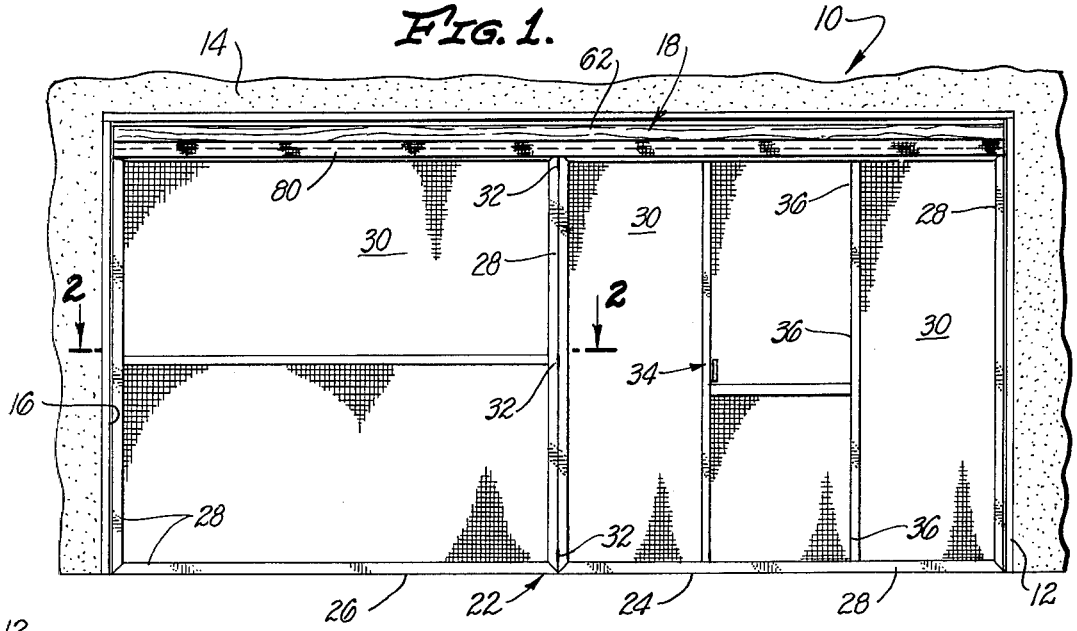
FIG. 1 is a front elevational view of a presently preferred embodiment or form of one of such structures.
Figure 2:
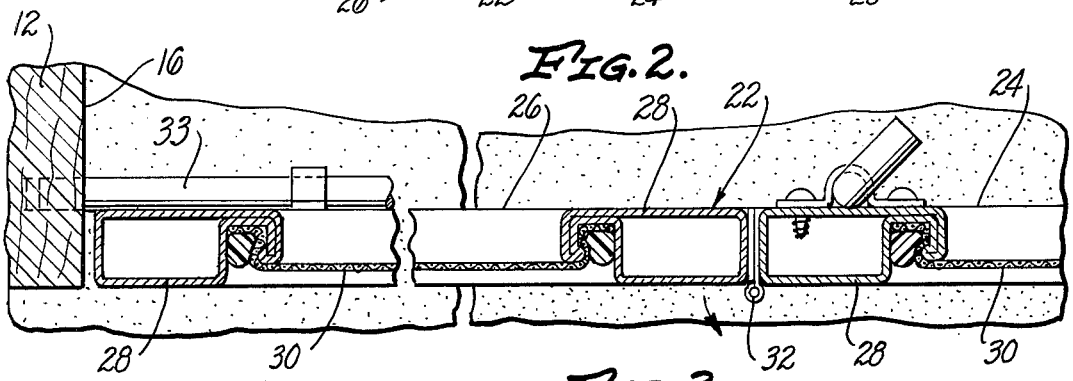
FIG. 2 is a partial cross-sectional view on an enlarged scale taken at line 2—2 of FIG. 1.

The various structures illustrated in these drawings embody certain concepts or principles as are set forth and defined in the appended claims. From a consideration of the different views of the drawing it is believed that it will be apparent that these concepts or principles can easily be embodied in a number of somewhat differently constructed door structures through the use or exercise of routine design or engineering skill.

DETAILED DESCRIPTION

Figure 3:
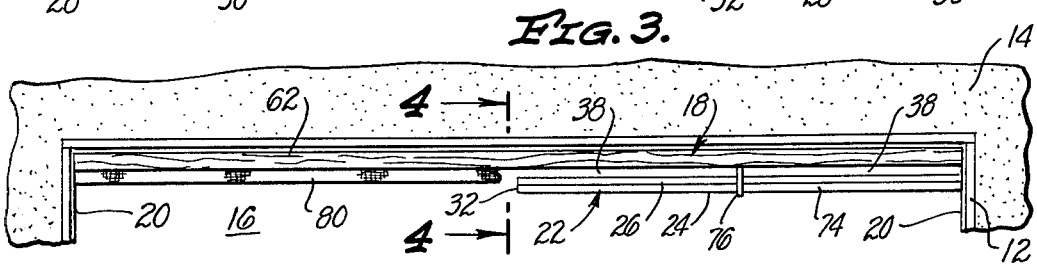
FIG. 3 is a partial front elevational view corresponding to FIG. 1 in which both a principal door and an auxiliary door are shown in an opened position.
Figure 4:
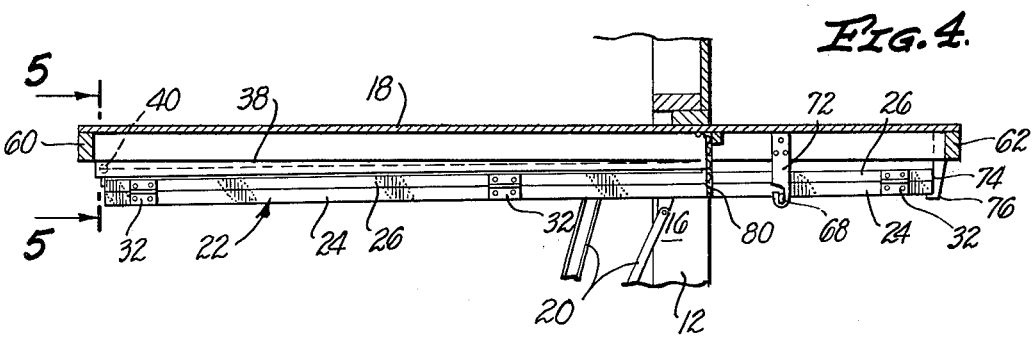
FIG. 4 is a partial cross-sectional view taken at line 4—4 of FIG. 3.

In FIGS. 1 through 8 of the drawings there is shown a door structure 10 in accordance with this invention in use in connection with a door jam 12 in a conventional building 14. This door jam 12 defines what may be considered as a conventional garage door opening 16 which is adapted to be closed by a conventional principal door 18. This door 18 is a rigid, single panel door and is mounted by a conventional mounting structure 20 so that it can be rotated between a closed position in which it extends substantially vertically across the door opening 16 and an opened position in which it extends substantially horizontally adjacent to the top of the door opening 16. In all figures of the drawings in which the door 18 is illustrated it is shown in an opened position. In this opened position it extends across a part of the door jam 12 as indicated in FIG. 4.

In accordance with this invention the door 18 is used with an auxiliary screen door 22 which is adapted to enclose the door opening 16 as shown in FIG. 1 when the screen door 22 is in an opened position. This door 22 is adapted to be located along and generally parallel to the door 18 as indicated in FIGS. 3 and 4 when it is in a closed position. This screen door 22 includes a first section 24 and a second section 26. Each of the sections 24 and 26 is adapted to cover substantially one-half of the door opening 16. These sections 24 and 26 include conventional frame members 28 and screens 30. These sections 24 and 26 are connected by means of hinges 32 so that the section 26 may be folded in such a manner as to lie against the section 24. A conventional sliding bolt 33 may be used to hold the section 26 with respect to the jamb 12.

If desired, either the first section 24 or the second section 26 may be constructed so as to include a secondary screen door 34 which can be opened and closed in a conventional manner when the door 22 is in an opened position. This secondary screen door 34 is shown as being mounted on the first section 24 in a conventional manner. When the secondary screen door 34 is used it may be either mounted upon the section 24 or 26 upon which it is used on hinges 36 or in such a manner that it may be slid back and forth. No mechanism is shown for slidably mounting such a secondary screen door 34 since such sliding mechanisms are well known and form no part of the present invention.

Channels 38 are mounted on the door 18 for use in supporting the screen door 22. These channels 38 are in effect in the nature of tracks which serve to support rollers 40 so that these rollers 40 may be moved along the lengths of these chanels 38. The rollers 40 are carried upon conventional axles 42 which in turn are carried by generally "U" shaped brackets 44. These brackets 44 are provided with aligned holes 46. Support rods 48 extend through these holes 46. Preferably coil springs 50 are located about the rods 48 and are held under a degree of compression through engagement with the brackets 44. These springs 50 will normally tend to bias the rods 48 in an upward position when the door 18 is in an opened position. These rods 48 have bent ends 54 remote from the stops 52 which are pivotally connected to the screen section 24 through the use of clamps 56.

Because of their function, if desired each assemblage of a roller 40, an axle 42, and a bracket 44 may be referred to as a carriage or a carriage means (not separately numbered). Similarly, the rods 48 may be regarded as means for mounting the screen door 22 on such carriage means. Also the springs 50 may be referred to as biasing means because of their function as hereinafter indicated. This function is related to the utilization of the screen door 22.

When the screen door 22 is being moved from its closed position as shown in FIG. 1 the section 26 is folded so as to overlie the section 24. Although it is not necessary conventional means (not shown) such as a fastener may then be used to lock these two sections 24 and 26 together. In order to further move the screen door 22 to an opened position the door 22 will then be manipulated so as to move the rollers 40 out of depressed portions 58 of the channels 38 and to move these rollers 40 along the lengths of these channels 38 until the rollers 40 are positioned substantially adjacent to what may be regarded as the upper edge 60 of the door 18. It will be realized, however, that this edge 60 is elevated substantially the same distance as what may be referred to as a lower edge 62 of the door 18 when this door 18 is in an opened position as the screen door 22 is being moved to its opened position.

Figure 5:
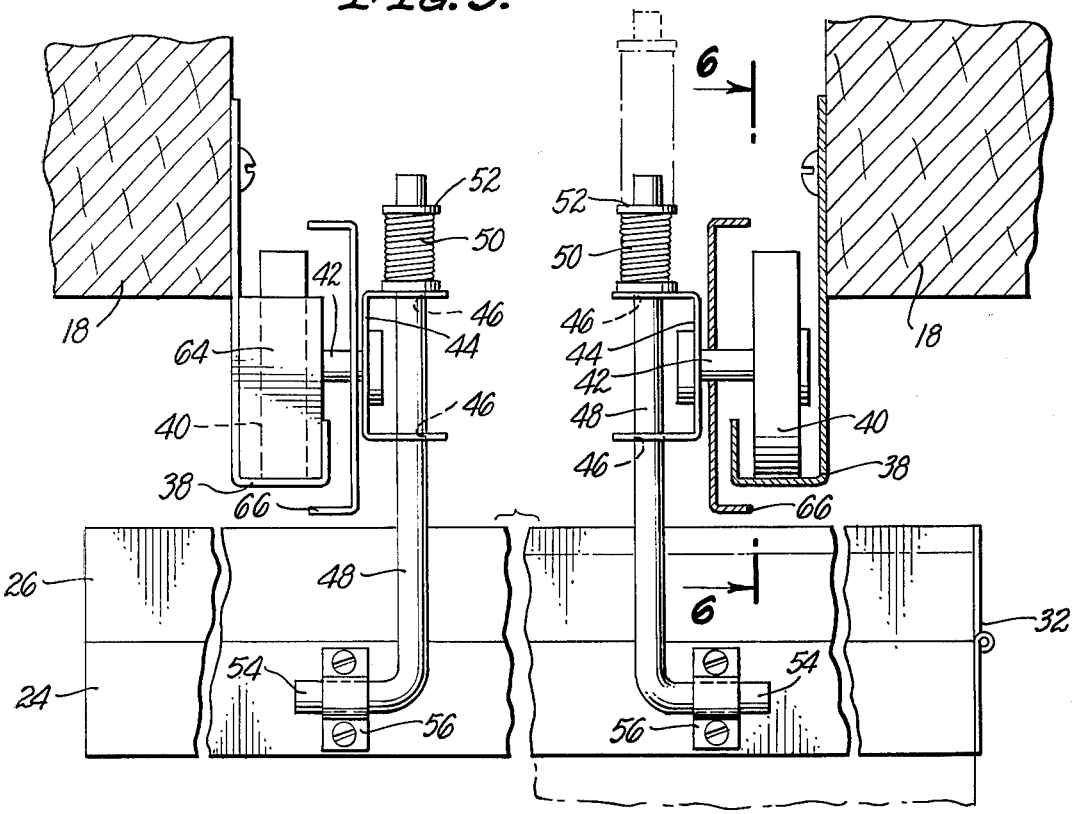
FIG. 5 is a partial cross-sectional view on an enlarged scale taken at line 5—5 of FIG. 4.
Figure 6:
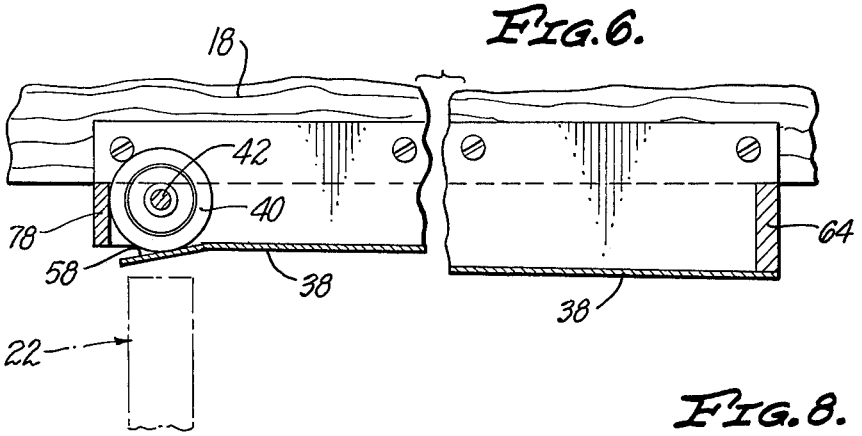
FIG. 6 is a partial cross-sectional view taken at line 6—6 of FIG. 5.
Figure 7:
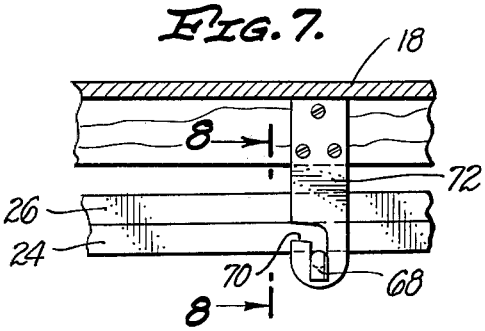
FIG. 7 is an enlarged detail view of part of the structure visible in FIG. 4.
Figure 8:
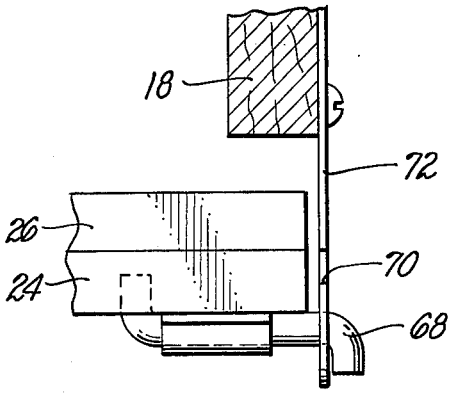
FIG. 8 is a partial cross-sectional view taken at line 8—8 of FIG. 7.

When the rollers 40 reach stops 64 at the ends of the channels 38 adjacent to this upper edge 60 the entire door 22 may be easily pivoted to a position as indicated in FIGS. 3, 4 and 5 of the drawings. Normally the screen door 22 will be sufficiently light in weight so that it can be rotated in this manner with little difficulty. As this occurs the section 26 will tend to engage auxiliary brackets 66 carried by the brackets 44 so as to cause a force to be exerted so as to cause a force to be exerted which will tend to compress the springs 50 in such a manner as to accommodate the entire door 22 so that it will be disposed substantially parallel to the channels 38 and the door 18.

At this point the door 22 may be pulled a short distance generally toward the edge 62 so as to cause bent rods 68 mounted upon the first section 24 to move into bent notches 70 on small brackets 72 supported by the door 18. As this occurs the door 22 will be moved to a position in which a lower edge 74 on it is generally above a hook 76. This hook 76 is mounted on the door 18 adjacent to the lower edge 62. At this point the door 22 may be released so as to allow the rods 68 to slide downwardly within the notches 70. At this point the hook 76 will assist in supporting the door 22. This will serve to "lock" or hold the screen door 22 upon the door 18 so that this door 18 may be opened and closed in a conventional manner.

With this structure whenever the door 18 is in an opened position the screen door 22 may be lifted upwardly by engagement adjacent to the lower edge 62 and may be then pushed slightly toward the upper edge 60 so as to release the rods 68 from the notches 70 and so as to space the door 22 from the hook 76. At this point the door 18 is preferably pulled so as to cause the rollers 40 to move forwardly along the channels 38 until such time as these rollers 40 move into the depressed portions 58 serving as locating means. Further movement of the rollers 40 in this direction is preferably prevented by other stops 78 mounted on the channels 38. When the rollers 40 are in this position the door 22 may be lowered so as to extend substantially vertically. With the preferred construction illustrated this door 18 will then be generally within the door opening 16. At this point the section 26 may be unfolded from the section 24 so that this door 22 will substantially close the door opening 16.

In this closed position of the door 22 there is a possibility that some insects could enter into the building 14 in the limited space between the doors 18 and 22. In case this insect problem might be significant it is possible to mount on the door 18 generally transverse to the channels 38 an elongated flexible flap 80 which will engage the sections 24 and 26 of the door 22 when the door 22 is in a closed position. This flap 80 is sufficiently long to extend completely across the door 18.

Figure 9:
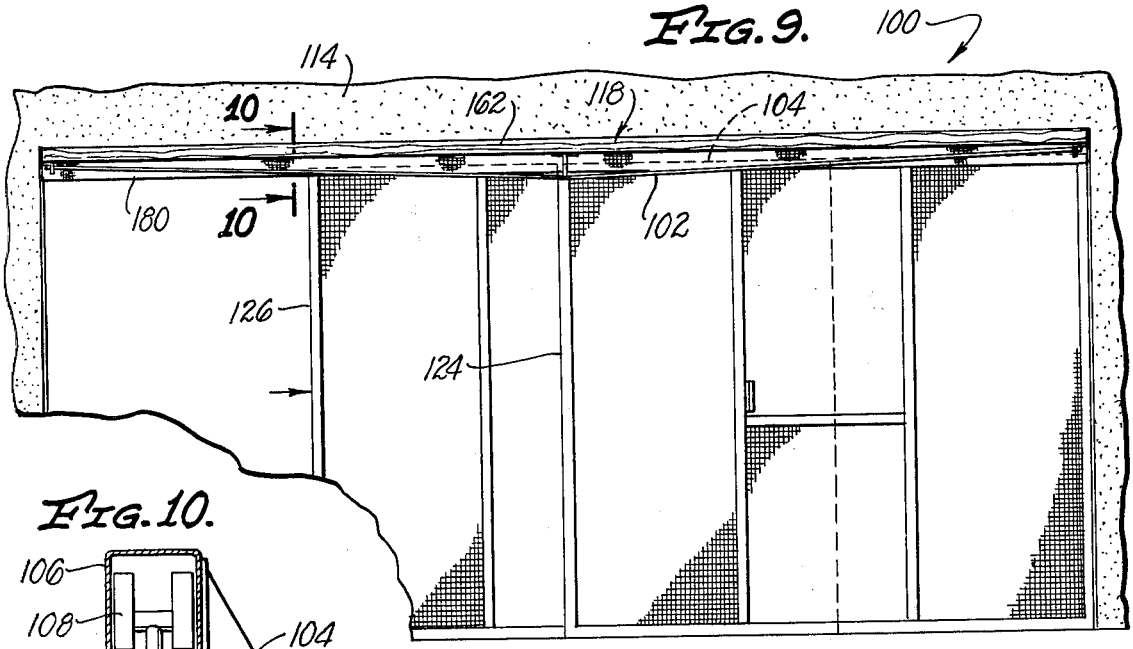
FIG. 9 is a partial front elevational view of a modified embodiment or form of a door structure in accordance with this invention.
Figure 10:
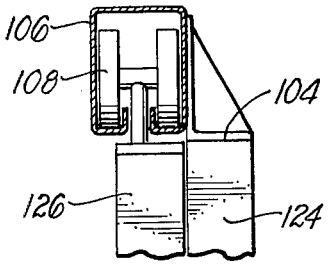
FIG. 10 is a partial cross-sectional view taken on an enlarged scale at line 10—10 of FIG. 9.

In FIG. 9 of the drawings there is shown a modified door structure 100 which is very closely related to the door structure 10. In the interest of brevity those portions of the door structure 100 which are identical to various portions of the door structure 10 and which are unnecessary to an understanding and/or description of the door structure 100 are either not illustrated and/or described herein or are indicated in the drawing and, where necessary for explanatory purposes, are indicated in the specification by the numerals previously used to designate such parts preceded by the numeral "1".

The door structure 100 differs somewhat from the door structure 10 inasmuch as it is intended to be utilized with a door 118 possessing a truss-like stabilizing rod 102 adjacent to its lower edge 162. This rod 102 is located in such a position that the section 126 of the screen door 122 cannot be pivoted with respect to the section 124 in the same manner in which the section 26 of the door 22 can be pivoted with respect to the section 24.

The upper edge 104 of the section 124 carries an elongated channel 106 of a type conventionally utilized in connection with overhead supported doors. This channel 106 is connected to the door section 126 by conventional carriages 108 of a type normally used with such a channel 106. This structure permits the section 126 to be moved linearly with respect to the section 124 so that the two sections 124 and 126 can be handled together as a unit in the manner previously described. To obtain this manner of operation the sections 124 and 126 must be parallel to one another and preferably they are located so that the section 126 moves substantially against the section 124 as the section 126 is manipulated.

Figure 11:
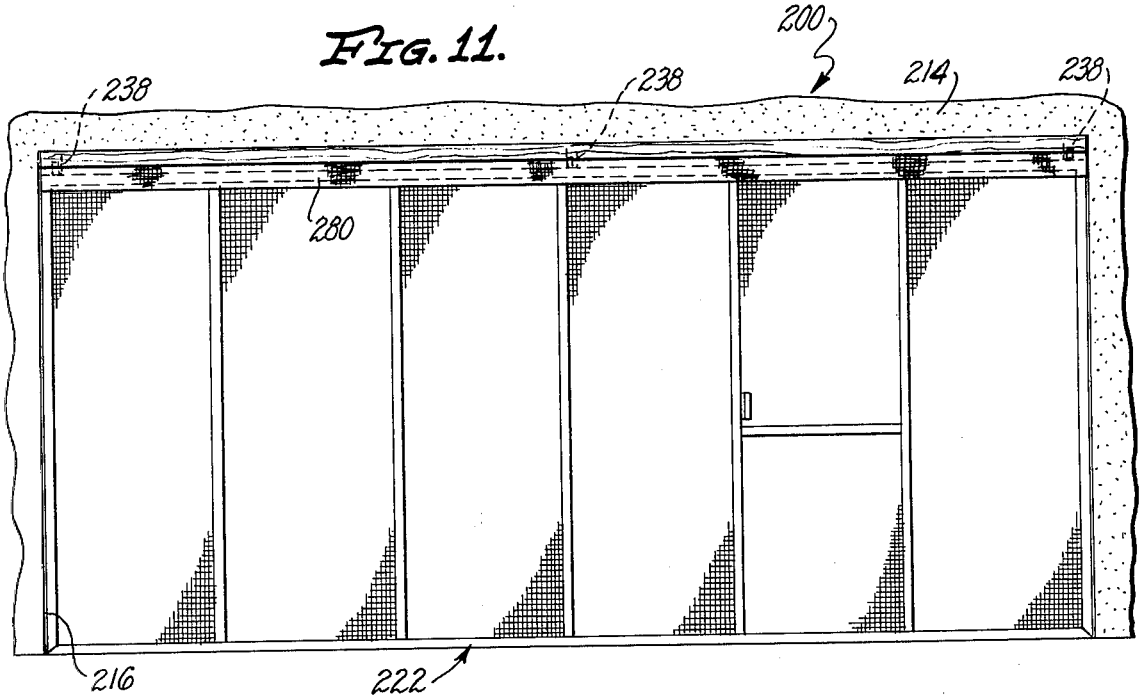
FIG. 11 is a front elevational view of a third embodiment or form of a door structure in accordance with this invention.

In FIG. 11 of the drawings there is shown another modified door structure 200 which is also very closely related to the door structure 10. In the interest of brevity those portions of the door structure 200 which are identical or substantially identical to various portions of the door structure 10 and which are unnecessary to an understanding and/or description of the door structure 200 are either not illustrated and/or described herein or are indicated in the drawing and, where necessary for explanatory purposes, in the specification by the numerals previously used to designate such parts preceded by the numeral "2".

The door structure 200 differs from the door structure 10 in that the screen door 222 used is an elongated "unit" or rigid door which is not sectionalized. When an elongated auxiliary door 222 of this type is used it is considered advisable to employ three different channels 238 and three different sets of parts for one with the channels 238 as will be apparent from the aforegoing so as to support the door 222 at both of its ends and along its middle (neither ends nor middle numbered).

In FIGS. 12 through 15 of the drawings there is shown a further modified door structure 300 of the present invention which is adapted to be utilized in connection with a door opening 302 defined by a door jamb 304 in a building 306. This door structure 300 includes a conventional sectionalized principal door 308 consisting of a plurality of rectilinear rigid panels 310 joined in side-by-side relationship in such a manner that these panels 310 may be pivoted with respect to one another. These panels 310 carry small brackets 312 holding rollers 314 which ride within tracks 316 mounted on the building 306. These tracks 316 extend vertically along the jamb 304 and then curve so as to extend horizontally into the interior of the building 306. It is to be understood that two of the tracks 316 are used and that these tracks 316 are disposed in parallel planes generally on opposite sides of the door opening 302.

Inasmuch as the construction of the door 308 and inasmuch as the mounting of this door 308 on the tracks 316 are conventional, it is not considered necessary to further describe either this door 308 or the tracks 316. In accordance with the present invention the panel 310 which is in the uppermost position when the door 308 is closed is secured to two parallel extension plates 318. These plates 318 extend parallel to the tracks 316 and in effect serve as elongated extensions on the particular panel 310 noted. These plates 318 are provided with elongated slots 320 which serve more or less as bearings for pins 322. These pins 322 are carried upon what may be regarded as "free" ends of elongated (not separately numbered) rigid angles or structural members 324 formed so as to include roller channels or tracks 326. The ends (not separately numbered) of the angles 324 remote from the pins 322 are supported by hinges 328 on the lowermost portion (not separately numbered) of the lowermost of the panels 310 when the door 208 is in a closed position.

This structure is designed so that the pins 322 can slide within the slots 320 as the door 308 is moved from a closed position as shown in FIG. 12 to an opened position in which it extends substantially horizontally as it is supported by the tracks 316. It will be realized that as the door 308 is moved between these opened and closed positions that the distance between the portions (not separately numbered) of the door 308 which are farthest removed from one another will change. As a consequence of the pins 322 sliding within the slots 320, the angles 324 can move with the door 308 as it is moved between these opened and closed positions.

With the door structure 300 an auxiliary screen door 330 is carried by the channels 326 as the door 308 is moved between these opened and closed positions. This door 330 is constructed so as to utilize the usual framing members 332 and screening 334. If desired it can be constructed so as to include a secondary door (not shown) corresponding to the door 34. The door 330 is mounted on the channels 326 through the use of small brackets 336 holding rollers 338 which ride within the channels 326. These brackets 336 and channels 326 can be considered as carriages. Normally the door 330 is prevented from pivoting relative to the angles 324 as the door 308 is moved through the use of a small wing nut type fastener 340 connecting the door 330 to one of the angles 324.

The use of the door structure 300 is essentially very similar to the utilization of the door structures previously described. When the door 308 is in an opened position the fastener 340 may be disengaged so as to allow the door 330 to swing downwardly as it is supported by the rollers 338 in the channels 326 to the portions of these channels closest adjacent to the jamb 304. Normally the channels 326 will slope downwardly at a moderate angle as the door 330 is moved in this manner, since normally the door 308 will only be opened to a sufficient extent to expose substantially all of the door opening 302.

When the rollers 338 travel as far as they can before hitting stops 344 within the channels 326 the door 330 may be pivoted downwardly to a closed position in which it substantially extends across all parts of the door opening 302. When the door 330 is to be opened it may be rotated from this closed position and pushed so as to move the rollers 338 in the channels 326 until such time that it can be further manipulated in an obvious manner so as to engage the fastener 340. Although it is not normally necessary auxiliary fasteners or latches may be utilized to hold the door 308 in an opened position as the door 330 is manipulated and/or to secure the door 330 in a closed position.

I claim:

1. In the combination of a principal door, first mounting means for supporting said principal door, a door frame defining a door opening, said first mounting means supporting said principal door so that it is capable of being moved between a substantially vertical closed position in which it extends across said door opening and a substantially horizontal opened position adjacent to the top of said door opening, an auxiliary door, an auxiliary mounting means for supporting said auxiliary door, said auxiliary mounting means supporting said auxiliary door so that it is capable of being moved between a substantially vertical closed position in which it extends across said door opening and an opened position in which it does not extend across said door opening, the improvement comprises:

said auxiliary mounting means serving to support said auxiliary door on said principal door so that said auxiliary door is moved concurrently with said principal door when said principal door is moved between its closed and opened positions, said auxiliary mounting means also supporting said auxiliary door on said principal door so that when said principal door is in its opened position said auxiliary door can be moved relative to said principal door from an opened position adjacent to said principal door to said closed position of said auxiliary door.

2. The combination claimed in claim 1 wherein:

said auxiliary door is a screen door, said principal door comprises a single, rigid panel, said auxiliary mounting means pivotally connects said auxiliary door with said principal door so that when said principal door is in its opened position said auxiliary door may be pivoted downwardly from said principal door to its closed position, said auxiliary mounting means includes support means for holding said auxiliary door along and adjacent to said principal door so that said auxiliary door can be moved concurrently with said principal door when said principal door is moved between its closed and opened positions.

3. The combination claimed in claim 2 wherein:

said auxiliary mounting means also includes track means on said principal door and roller carriage means for movement along said track means on said auxiliary door, said carriage means engaging said track means so that said auxiliary door may be moved with respect to said principal door as it is moved between its opened and closed positions, said carriage means permitting said auxiliary door to be moved with respect to said principal door so as to be located adjacent to and along one side of said principal door when said auxiliary door is in said closed position and permitting said auxiliary door to be pivoted to said opened position.

4. The combination claimed in claim 3 wherein:

said track means include locating means for positioning said carriage means relative to said principal door so that said auxiliary door is located within said door opening.

5. The combination claimed in claim 3 wherein:

said auxiliary door comprises two door sections, said sections being capable of being moved relative to one another so that one of said sections overlies the other of said sections, said auxiliary mounting means serving to hold said auxiliary door in said closed position of said auxiliary door with said sections overlying one another.

6. The combination claimed in claim 5 wherein:

said sections are pivotally connected to one another so as to be capable of being pivoted with respect to one another.

7. The combination claimed in claim 5 wherein:

said sections are slidably connected to one another so that one of said sections may be slidably moved with respect to the other of said sections along a linear path.

8. The combination claimed in claim 1 wherein:

said auxiliary door is a screen door, said screen door having a secondary screen door located therein, said secondary screen door being of smaller dimension than said auxiliary door.

9. The combination claimed in claim 1 wherein:

said auxiliary door is a screen door, said principal door comprises a plurality of rigid panels joined in side-by-side relationship so that said panels may be pivoted with respect to one another, said first mounting means supports said panels so that said panels move along a curved path as said principal door is moved between said opened and closed position of said principal door, said auxiliary mounting means includes rigid elongated channel means, said channel means being mounted on said panels so as to accommodate a change in distance between remote panels of said principal door during movement of said principal door between said opened and closed positions, and said auxiliary mounting means also including roller carriage means engaging said channel means, said roller carriage means supporting said auxiliary door on said channel means, so that said auxiliary door can be moved between its opened and closed positions, said auxiliary mounting means also including support means for holding said auxiliary door with respect to said channel means so that said auxiliary door can be moved concurrently with said principal door as said channel means are moved when said principal door is moved between its closed and opened positions.

10. The combination claimed in claim 9 wherein:

said channel means are pivotally connected to one of said panels at one extremity of said door and are movably connected to another of said panels furthest remote from one of said panels so as to be capable of accommodating a change in distance between said one of said panels and said other of said panels.

11. The combination claimed in claim 10 wherein:

said auxiliary mounting means also included extension means connected to said other of said panels and, said connection between said other of said panels and said panels means comprises a sliding connection between said extension means and said channel means.

* * * * *